United States Patent [19]

Taylor et al.

[11] Patent Number: 4,977,818

[45] Date of Patent: Dec. 18, 1990

[54] AIR FLOW CONTROL SYSTEM

[76] Inventors: Harry L. Taylor; Charles O. Ehret, both of 54 Buckley Meadows Dr., St. Louis, Mo. 63125

[21] Appl. No.: 357,205

[22] Filed: May 26, 1989

Related U.S. Application Data

[63] Continuation-in-part of Ser. No. 222,956, Jul. 22, 1988, Pat. No. 4,928,583.

[51] Int. Cl.[5] ..... F24F 11/00

[52] U.S. Cl. ..... 98/31.6; 98/42.03; 251/129.11

[58] Field of Search ..... 98/31.6, 42.03, 42.12, 98/42.15, 42.19, 85, 1, 116; 137/80; 251/129.11, 228, 357

[56] References Cited

U.S. PATENT DOCUMENTS

| | | | |
|---|---|---|---|
| 1,002,308 | 9/1911 | Powers . | |
| 1,004,074 | 9/1911 | Powers . | |
| 2,299,317 | 10/1942 | Fink | 98/42.12 X |
| 2,632,377 | 3/1953 | Mader | 98/116 |
| 3,060,833 | 10/1962 | Pledger . | |
| 3,951,051 | 4/1976 | Dry . | |
| 4,017,026 | 4/1977 | Felter . | |
| 4,432,272 | 2/1984 | Becelaere . | |
| 4,559,867 | 12/1985 | Van Becelaer et al. . | |
| 4,633,769 | 1/1987 | Milks | 98/116 X |
| 4,738,190 | 4/1988 | Sheu | 98/116 |

*Primary Examiner*—Harold Joyce

*Attorney, Agent, or Firm*—Senniger, Powers, Leavitt & Roedel

[57] ABSTRACT

An air flow control system for controlling the air flow within a building having closable vents for venting the air out the building comprising sensors for detecting fire, smoke, gas, or high heat in the building and an alarm for indicating the detection of fire, smoke, gas, or high heat in the building. The system also includes motors, connected to the system, for closing the vents upon the detection of fire, smoke, gas, and high heat in the building.

14 Claims, 3 Drawing Sheets

AIR FLOW CONTROL SYSTEM

This application is a continuation-in-part of copending application Ser. No. 222,956 filed July 22, 1988 now U.S. Pat. No. 4,928,583.

BACKGROUND OF THE INVENTION

This invention relates to a system for controlling the air flow within a building and in particular to a system which detects smoke, fire, gas, or high heat and automatically reduces the air flow within a building.

In the case of detecting smoke, fire, gas, or high heat within a building it is desirable to cut off the flow of air within the entire building to prevent smoke and gas from circulating, fire from burning, and to retard heat flow. Automatically closing fire dampers for air ducts are well known, examples of which are disclosed in the following U.S. patents: Dean, Jr. et al., U.S. Pat. No. 3,687,055; McNabney et al., U.S. Pat. No. 3,785,272; Maxson, U.S. Pat. No. 4,397,223; and Barchechat et al., U.S. Pat. No. 4,545,363. However, these automatic closable damper devices only operate in the room in which the fire occurs. Also, some of these prior art devices are only activated upon the melting of a fusible link which may not melt in time to prevent smoke from escaping through the air ducts to other parts of the building. Additionally, most buildings have a ventilation system, such as an air conditioner or a furnace, which includes a blower for circulating air in the building. If the blower is allowed to operate during, for example, a fire the circulated air will feed the fire. Therefore, in addition to closing the vents it is also advantageous to disable the blower. It is also advantageous to know when any of the damper devices has been operated and the blower has been disabled.

SUMMARY OF THE INVENTION

Among the objects of the present invention is the provision of an air flow control system which is capable of automatically closing all the vents in a building and disabling the blower which recirculates air in the building to control the air flow within the building upon the detection of fire, smoke, gas, or high heat in the building; the provision of such a system which indicates when the system has closed the vents and disabled the blower; the provision of such a system which is reset only after the detected event has been cleared; the provision of such a system which is of simple construction for low cost and highly reliable operation; the provision of such a system that can be easily installed and incorporated into new buildings; the provision of such a system that can be easily installed in existing buildings; and the provision of such a system in which the vents and the blower can be easily and quickly reset.

The air flow control system of the present invention is adapted for use in a building having vents for venting air out of the building to control the air flow within the building upon the detection of fire, smoke, gas, or high heat in the building. Generally, the air flow control system of the present invention comprises means for detecting fire, smoke, gas, or high heat in the building, means for indicating the detection of fire, smoke, gas, or high heat connected to the detecting means, and means for closing the vents upon the detection of fire, smoke, gas, or high heat in the building connected to the detecting means.

Another form of the invention includes an air flow control system for controlling the air flow within a building in combination with a building having a roof, a plurality of walls and rooms, one of the rooms having a blower for circulating the air in the building, and a plurality of vents in the rooms and the roof. The air flow control system comprises means for detecting fire, smoke, gas, or high heat in the building, and means for indicating detection of fire, smoke, gas, or high heat in the building connected to the detecting means.

According to the present invention, a vent adapted for use in an air flow control system comprises a cylindrical housing having an air inlet end and an air outlet end, a circular damper blade positioned in the housing and operably connected to the housing and movable between an open and a closed position, a driving link connected to the blade and having both ends extend out of the housing, a motor connected at one end of the link and the other end connected to a cam.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
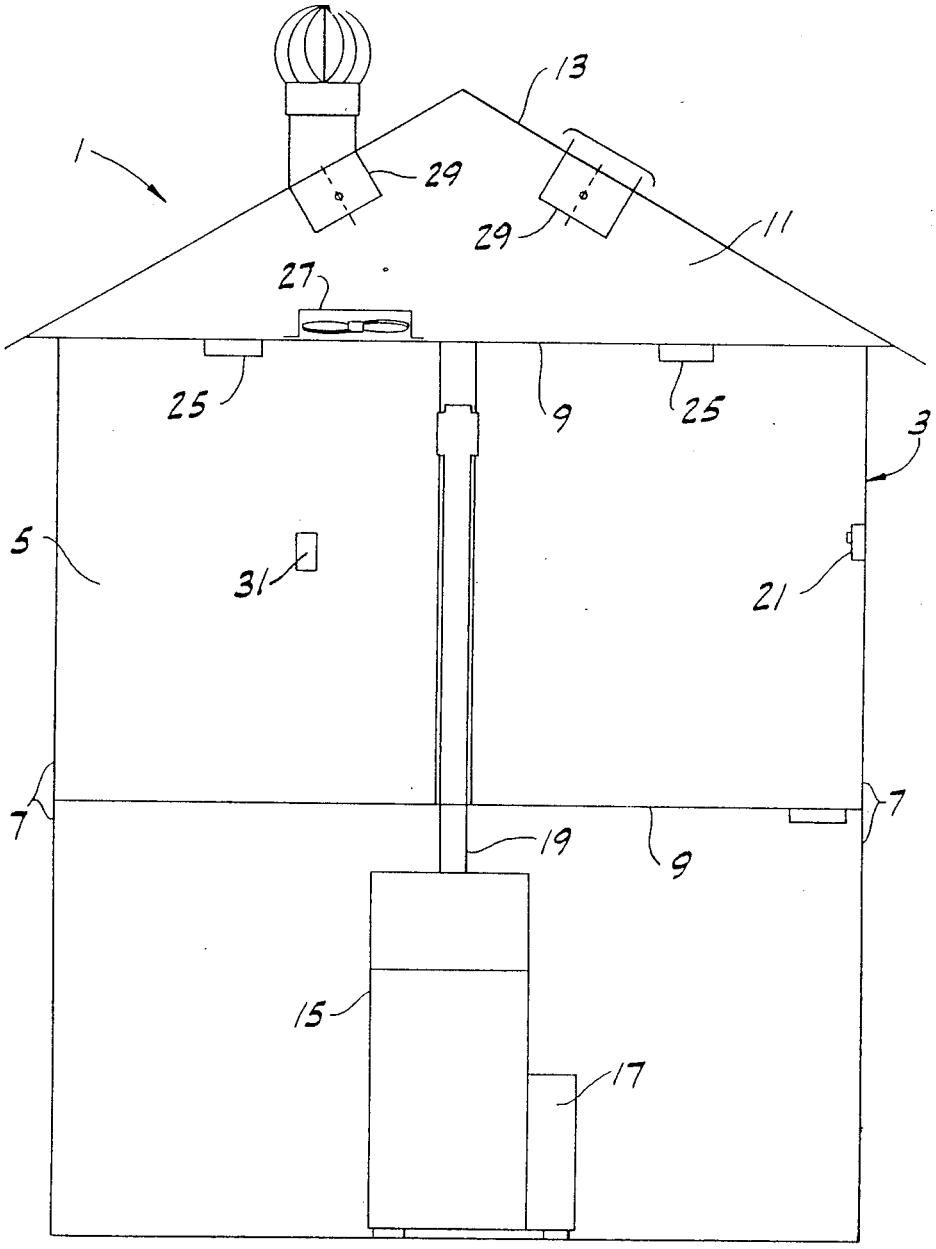
FIG. 1 is a schematic diagram of an air flow control system of the present invention installed in a building.

The control system of the present invention, indicated generally as 1 in the figures, is shown as it would be installed in a building 3. It is to be understood that building 3 may be a residential building, a commercial building, or a multi-story building. Building 3 includes a living space 5 having a plurality of walls 7, a plurality of ceilings 9, an attic 11, and a roof 13. A furnace 15 having a blower motor 17 for circulating air through a duct system 19 to various areas in the building 3 is controlled by a thermostat 21. Furnace 15 also includes a furnace vent (not shown).

A plurality of sensors 25 for detecting fire, smoke, gas, or high heat are placed on the ceilings 9 at various locations in the building 3. For example, building codes may require that a sensor be placed within ten feet of any bedroom. The sensors 25 are an example of means for detecting fire, smoke, gas, or high heat. Although each sensor 25 is shown in this embodiment as a combination smoke, fire, gas, or high heat sensor it is also possible to have individual sensors for detecting only fire or smoke or gas or high heat. Although each sensor 25 is shown in this embodiment as a combination smoke, fire, gas, or high heat sensor it is also possible to have individual sensors for detecting only fire or smoke or gas or high heat. Also, system 1 may be connected to an emergency warning system (not shown) which is directly wired to the fire department or a remote monitoring station for indicating that fire, smoke, gas, or high heat has been detected in the building.

The building 3 may also include an attic fan 27 and vents or roof power vents 29 for venting air out of the building 3 or the attic 11. Vents 29 are shown in the open position indicating that fire, smoke, gas, or high heat has not been detected and air flow is occurring. The system 1 also includes a reset switch 31 located in the living space 5.

Figure 2:
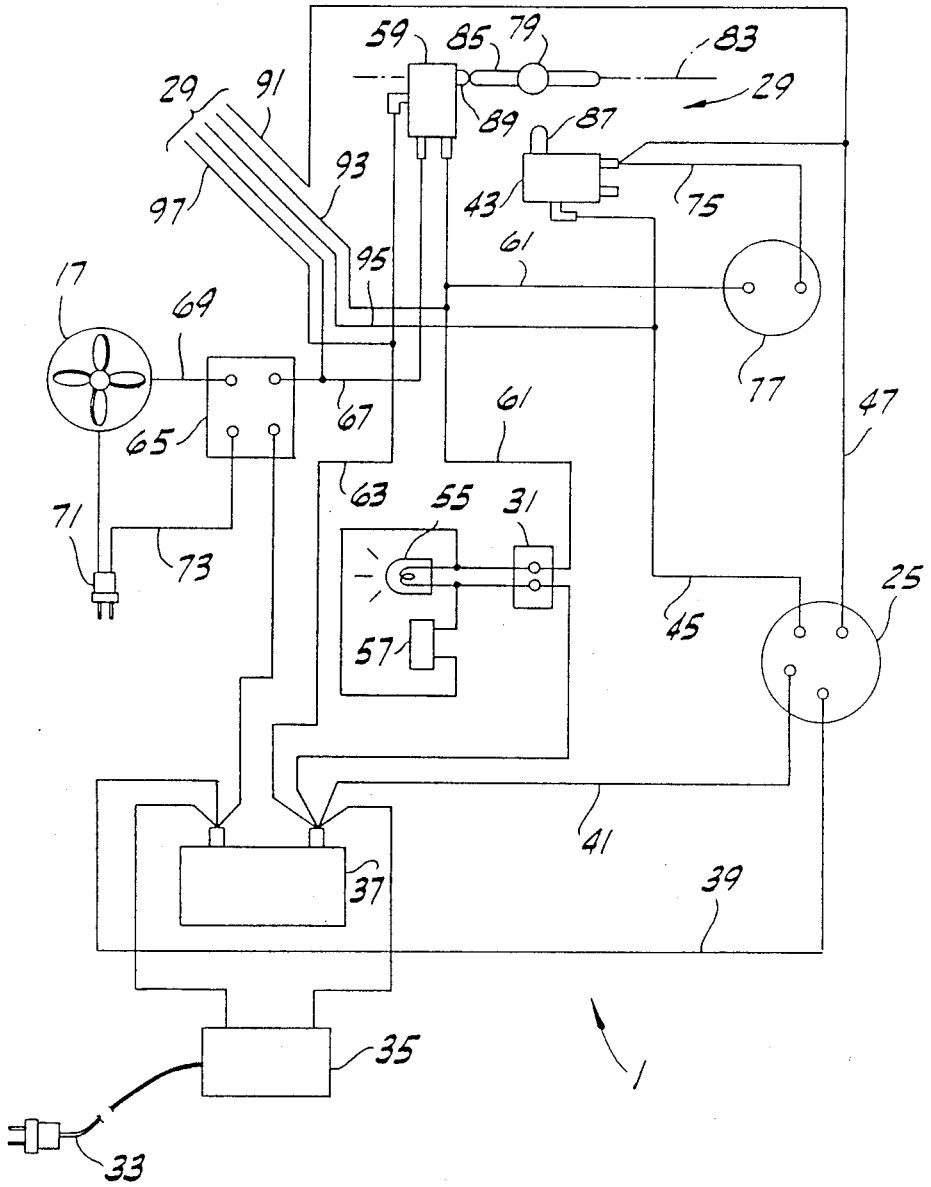
FIG. 2 is an electric schematic diagram of the air flow control system of FIG. 1.

FIG. 2 is an electrical schematic diagram of the system 1 shown in FIG. 1. The system 1 is connected to a power source, such as a 110 V a.c. power source (not shown) via a power cord 33. The cord 33 is connected to a battery charger 35 which charges a battery 37, such as a 12 volt d.c. gel cell type rechargeable battery. System 1 is powered by battery 37 to prevent interruption in the event of power failure of the 110 V a.c. power source. Battery 37 is connected to sensor 25 via lines 39 and 41. Although only one sensor 25 is shown in FIG. 2, it is to be understood that the system 1 may be connected to more than one sensor by, for example, lines 39 and 41. Sensor 25 is connected to a micro switch 43 via lines 45 and 47. Reset switch 31 may be a double pole single throw momentary switch. The switch 31 is connected to an indicator light 55 and may also be connected to other lights throughout the structure (not shown) and an audible alarm or siren 57. Additionally, the reset switch 31 is connected to a micro switch 59 via line 61. Micro switch 59 is connected to battery 37 via a line 63 and to a relay 65 via a line 67. Relay 65 controls the furnace blower motor 17 and is connected to motor 17 via a line 69. Motor 17 may be connected to a power source (not shown) via a power cord 71. Power cord 71 is also wired to relay 65 via a line 73. Relay 65 can also be wired to control the attic fan 27.

A line 75 connects micro switch 43 to a motor 77. Motor 77 is also connected to micro switch 59 via line 61. Motor 77 is operated to open or close the vent 29. Vent 29 has a cam 79 attached to a driving link 81 (see FIGS. 3 and 4) of a damper blade 83 (shown in phantom in FIG. 2). The cam 79 includes an end 85 which may be positioned to operate contacts 87 and 89 on the micro switches 43 and 59, respectively. The end 85 is an example of means for contacting the contacts 87 and 89. Motor 77 may be a gear motor which moves the damPer 83 a quarter turn in either direction in order for end 85 to touch either of the contacts 87 or 89. The end 85 is shown contacting the contact 89 to indicate that the detector 25 has made a detection and the damper blade 83 is in the closed position.

Lines 91, 93, 95, and 97 illustrate the connection for another vent 29 for the system 1.

Figure 3:
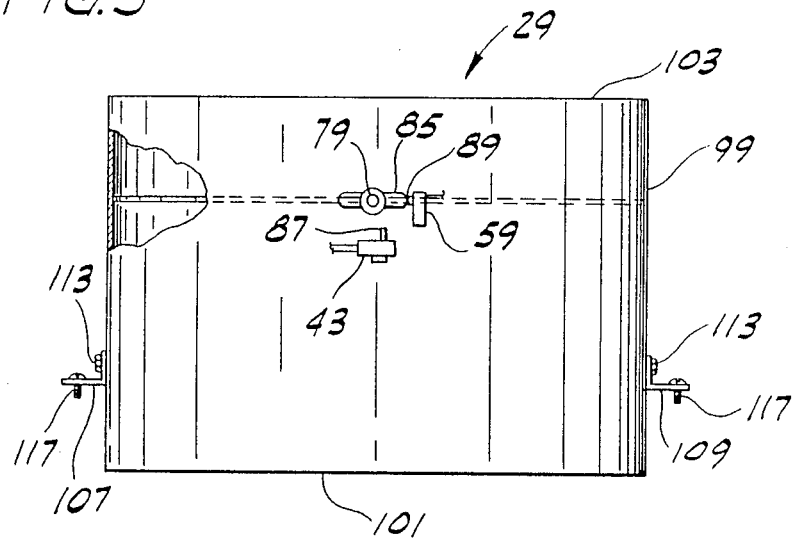
FIG. 3 is a side elevation view of a vent of the air flow control system shown in FIG. 1 in the closed position.
Figure 4:
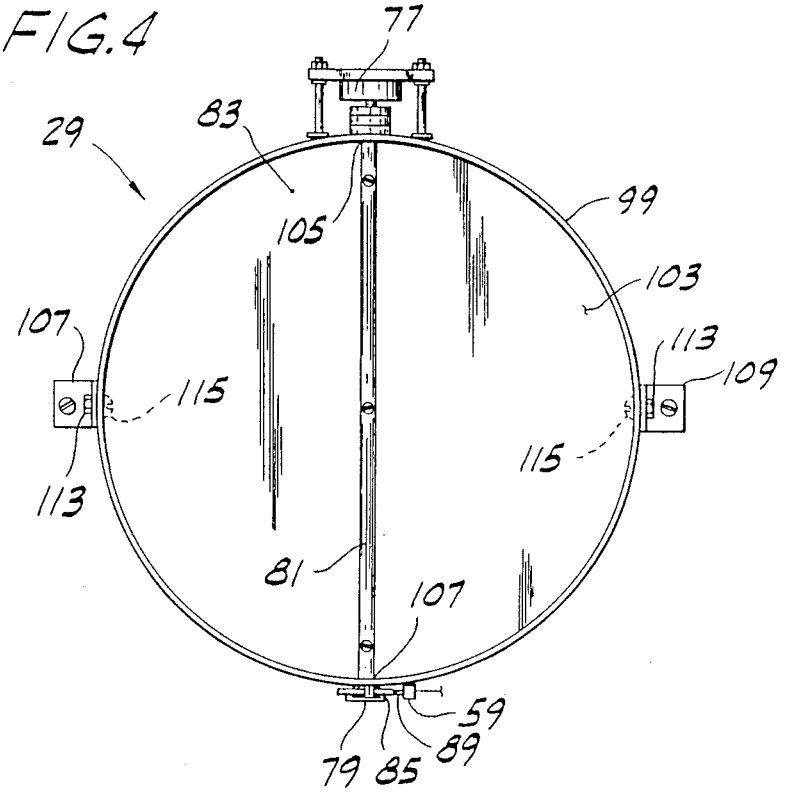
FIG. 4 is a top plan view of the vent shown in FIG. 3.

As shown in FIGS. 3 and 4 an embodiment of vent 29 is illustrated. Vent 29 includes a generally cylindrical housing 99 having an air inlet end 101 and an air outlet end 103. The circular damper blade 83 is positioned within housing 99 and connected to driving link 81 for movement between an open position and a closed position. Driving link 81 extends outside housing 99 through openings 105 and 107 in the side of housing 99 to where it is connected to motor 77 and cam 79. In the open position, blade 83 extends out from the air outlet end 103 of housing 99 and the end 85 of cam 79 comes into contact with contact 87 of micro switch 43. In the closed position, the end 85 of cam 79 comes into contact with contact 89 of micro switch 59 and blade 83 covers the air outlet end 102. The damper blade 83 is shown in the closed position in FIGS. 3 and 4 indicating that a detection has been made by the system 1.

A pair of brackets 107 and 109 are connected to the housing 99 with nuts 113 and bolts 115. The brackets 107 and 109 along with screws 117 facilitate mounting vent 29 to rafters (not shown) in the building 3 which are typically spaced apart 16 inches on center. In some older buildings where the rafters may be spaced apart 24 inches on center a pair of angle irons (not shown) will be needed to mount the vent 29 to the angle irons which are in turn connected to the rafters.

The concept of this invention is that any vent or device which creates circulation of air in a building can be controlled to stop air circulation within the building upon the detection of fire, smoke, gas, or high heat. If the air circulation can be cut off or at least significantly reduced, then the fire will burn itself out and smoke will not circulate. In operation, vents 29 are open, blower motor 17 is operating, and attic fan 27 may also be operating. System 1 is connected to the power source and battery 37 is powering the system 1. In the event sensor 25 detects fire, smoke, gas, or high heat the motor 77 on each of the vents 29 will be operated to close each of the damper blades 83. Upon closing of the blade 83, the end 85 of cam 79 will come into contact with contact 89 of micro switch 59 to disable blower motor 17 through relay 65 and to activate the reset switch 31, light 55, and alarm 59. Other lights (not shown) will also be illuminated to guide individuals out of the building 3. These other lights may be located at exits. Additionally, electric locks (not shown) may be connected to the system 1 at reset switch 31 to automatically open the locks upon detection. This allows the fire department access to the building 3 without having to damage the property in order to enter. Light 55 is illuminated to visually indicate that the system 1 has detected a fault condition such as smoke, fire, gas, or high heat. Additionally, alarm 57 is sounded to audibly indicate a fault condition such as smoke, fire, gas, or high heat.

As an added safety feature, reset switch 31 will not be able to reset the system 1 until each of the sensors 25 determine that the fault condition is cleared. Once the sensors 25 determine a clear condition, the reset switch 31 can be operated manually to open vent 29 by actuating motor 77. Also, relay 65 will enable blower motor 17. The light 55 and alarm 57 will be disable once the reset switch 31 is operated. As can be appreciated the air flow within the building is now controlled and reduced to prevent the spreading of smoke, gas, and fire and to retard heat flow.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. An air flow control system for controlling the air flow within a building having closable vents for venting air out of the building, each vent comprising a cylindrical housing having an air inlet end and an air outlet end, a circular damper blade positioned in the housing and operably connected to the housing and movable between an open and a closed position, and means for moving the blade comprising a driving link connected to the blade and having both ends extending out of the housing, the system comprising:

means for opening the vents;

means for detecting fire, smoke, gas, or high heat in the building;

means for indicating the detection of fire, smoke, gas, or high heat connected to the detecting means;

means for closing the vents upon the detection of fire, smoke, gas, or high heat in the building connected to the detecting means, the closing means comprising a motor connected to one end of the driving link for moving the damper blade between the open and the closed positions in response to the detecting means detecting fire, smoke, gas, or high heat in the building;

means for disabling the opening means to prevent the vents from opening until the detecting means determines that fire, smoke, gas, or high heat is no longer in the building;

switch means connected to the outside of the housing and electrically connected to the indicating means, the switch means including contacts; and a cam connected to the other end of the driving link, the cam including means for contacting the contacts for switching the indicating means.

2. The system of claim 1 wherein the indicating means comprises means for visually indicating the detection of fire, smoke, gas, or high heat.

3. The system of claim 2 wherein the visually indicating means comprises a light.

4. The system of claim 1 wherein the indicating means comprises means for audibly indicating the detection of fire, smoke, gas, or high heat.

5. The system of claim 1 wherein the detecting means comprises a sensor.

6. In combination with a building having a roof, a plurality of walls and rooms, one of the rooms having a blower for circulating the air in the building, and a plurality of vents in the rooms and the roof, the vents movable between a resettable open position and a closed position, an air flow control system for controlling the air flow within the building comprising:

means for detecting fire, smoke, gas, or high heat in the building;

means for indicating detection of fire, smoke, gas, or high heat in the building connected to the detecting means;

means for closing the vents upon the detection of fire, smoke, gas, or high heat in the building connected to the detecting means;

means for resetting the vents upon the detecting means determining that fire, smoke, or high heat is no longer in the building; and means for disabling the resetting means to prevent the vents from opening until the detecting means determines that fire, smoke, gas, or high heat is no longer in the building.

7. The combination of claim 6 wherein each vent comprises a cylindrical housing having an air inlet end and an air outlet end, a circular damper blade positioned in the housing and operably connected to the housing and movable between an open and a closed position, means for moving the blade, and wherein the closing means comprises a motor connected to the moving means for moving the damper blade between the open and the closed position in response to the detecting means detecting fire, smoke, gas, or high heat in the building.

8. The combination of claim 7 wherein the moving means comprises a driving link connected to the blade and having both ends extend out of the housing, the motor connected to one end of the link and the other end connected to a cam.

9. The system of claim 8 further comprising switch means connected to the outside of the housing and electrically connected to the indicating means, the switch means including contacts and the cam including means for contacting the contacts for switching the indicating means.

10. The combination of claim 6 further comprising means for disabling the blower upon the detection of fire, smoke, gas, or high heat in the building connected to the detecting means.

11. The combination of claim 6 wherein the detecting means comprises a sensor in each of the rooms.

12. The combination of claim 6 wherein the indicating means comprises means for visually indicating the detection of fire, smoke, gas, or high heat in the building.

13. The combination of claim 12 wherein the visually indicating means is a light.

14. The combination of claim 6 wherein the indicating means comprises means for audibly indicating the detection of fire, smoke, gas, or high heat in the building.

* * * * *